United States Patent [19]

Paranto

[11] Patent Number: 4,927,141

[45] Date of Patent: May 22, 1990

[54] NOVELTY BALL

[76] Inventor: Arlen C. Paranto, P.O. Box 304, Eatonville, Wash. 98328

[21] Appl. No.: 383,607

[22] Filed: Jul. 24, 1989

[51] Int. Cl.[5] ..... A63B 37/14; A63B 43/02

[52] U.S. Cl. ..... 273/58 K; 273/DIG. 20; 273/DIG. 8; 273/58 A; 273/58 C; 446/490

[58] Field of Search ..... 273/58 R, 58 K, 58 A, 273/58 C, 58 F, 58 J, DIG. 8, 428, DIG. 20; 428/11; 446/490

[56] References Cited

U.S. PATENT DOCUMENTS

| | | | |
|---|---|---|---|
| 3,231,925 | 2/1966 | Conder | 273/58 K |
| 3,759,518 | 9/1973 | Mroz | 273/58 K |
| 4,071,237 | 1/1978 | Hoogasian | 273/58 K |
| 4,200,288 | 4/1980 | di Donato | 273/428 |
| 4,294,447 | 10/1981 | Clark | 273/58 R |
| 4,321,888 | 3/1982 | Topliffe | 119/29 |
| 4,756,529 | 7/1988 | Stillinger | 273/58 K |

*Primary Examiner*—George J. Marlo
*Attorney, Agent, or Firm*—Keith D. Gehr

[57] ABSTRACT

The invention is a novelty ball having a multiplicity of extending flexible whisker-like protrusions. The whiskers are generally within the range of about 0.5 to 2.5 times the diameter of the ball. Materials of construction may vary but sponge rubber has been found to be very satisfactory for the ball and very small diameter surgical rubber tubing for the whiskers. As an example, a ball about 2½ inches in diameter may have about 14 to 20 whiskers. The balls when thrown will travel straight but roll to a stop very rapidly due to the whisker action. They are particularly useful for teaching children throwing and catching skills and for juggling since, when in the air, they appear considerably larger than their actual diameter.

10 Claims, 1 Drawing Sheet

Fig. 1
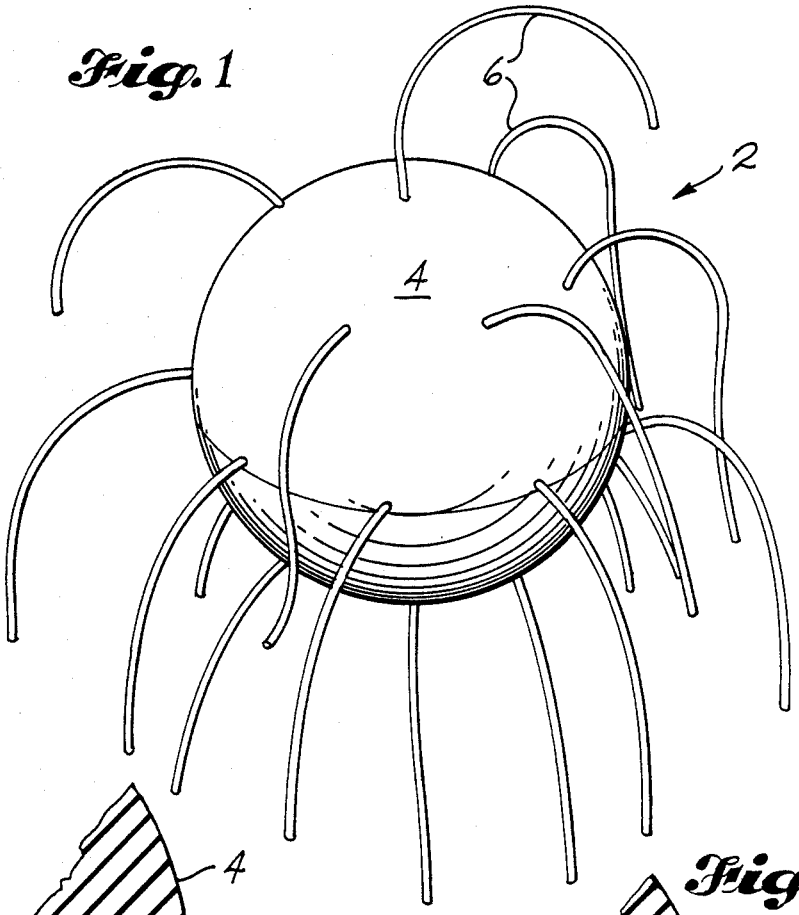
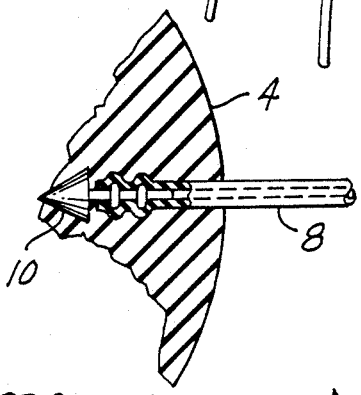
Fig. 2
Fig. 3
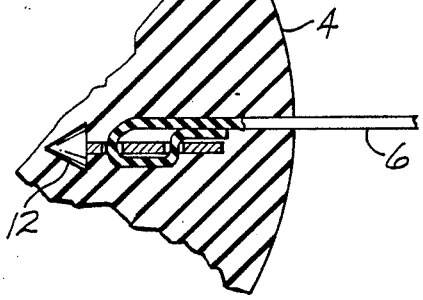
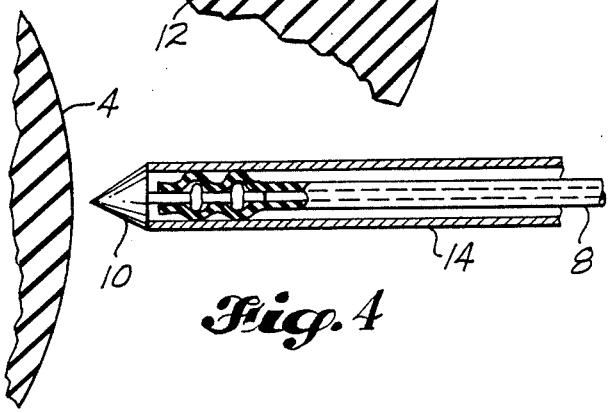
Fig. 4

NOVELTY BALL

BACKGROUND OF THE INVENTION

The present invention is a novelty ball useful for such purposes as teaching motor skills to children, as a practice ball for such sports as golf, tennis, or soccer, and for many other purposes where it is desirable for the ball to have a limited travel distance after being thrown or struck. The ball further has the feature that there is virtually no possibility of injury to a person who might accidentally be hit by it.

The prior art has many examples of balls purporting to accomplish the above purposes. These include "geodesic" balls, made of open triangles of stiffened string, yarn balls, apertured hollow plastic or "whiffle" balls, sponge or foam "Nerf" balls of various constructions, wool fleece balls, and balls with extending feathers, to name but a few. These can be found in novelty stores and are also available from dealers selling various types of athletic equipment to schools.

A throw toy somewhat similar to the present invention is described in U.S. Pat. No. 4,200,288 to di Donato. This has a body made of a cube or cylinder of a rigid or resilient material. It further has a plurality of extending "tail like members" which appear to be made from a very flexible cord. Each of these members has at its terminal end a small wing-like vane or "flutter flap" which spins when the toy is thrown. The tail-like members are said to make it easy for a child to catch the toy and to bring it to a rapid halt when it is rolling along the ground.

Topliffe, in U.S. Pat. No. 4,321,888, shows a ball-like canine toy having a number of attached tethers made of cord or string. The tethers are looped through pairs of molded openings lying along chords parallel to a polar axis of the ball. These are sized so that they can be gripped readily in the teeth of a small dog.

While all of the above ball-like toys are useful, they have not completely solved the problems inherent in a novelty ball that can be thrown or struck in a straight path, readily caught especially by a young child, and will stop quickly after hitting the ground. Additionally, many of them have problems of durability or manufacturing complexity and others are inherently unsafe and should not be used in the unsupervised play of children.

The novelty ball of the present invention appears to have solved most or all of the above problems and will now be described in detail.

SUMMARY OF THE INVENTION

The present invention comprises a novelty ball which is particularly useful for the development of throwing and catching skills in children, for juggling, and for use in indoor versions of outdoor games. It comprises a resilient ball, usually of spherical shape. A multiplicity of thin flexible whisker-like protrusions are relatively evenly spaced apart over the surface of the ball. These whiskers have some drape; i.e., they are not stiff like spines or bristles but neither do they hang limply from the ball such as cord or string might do. In general the whiskers will be in the range of 0.5 to 2.5 times the ball diameter. The whiskers may be unitary with the ball; e.g., molded integrally with the ball. More preferably they are individually inserted and retained within the ball. This construction allows the use of simple high speed production methods in addition to the use of high strength whisker materials of different composition from the ball itself.

It is an object of the present invention to provide a novelty ball useful as an educational toy and for various indoor and outdoor games.

It is another object to provide a ball that is easy for an unskilled person to see in the air and to catch.

It is a further object to provide a safe toy that will not cause injury in either supervised or unsupervised play.

These and many other objects will become readily apparent upon reading the following detailed description taken in conjunction with the drawings.

BRIEF DESCRIPTION OF THE DRAWINGS

FIG. 1 is a general perspective view of the novelty ball of the invention.

FIGS. 2 and 3 show retainers for the whiskers.

FIG. 4 shows a tool and method for inserting the whiskers and retainers.

DETAILED DESCRIPTION OF THE PREFERRED EMBODIMENTS

The present invention is a novelty ball formed from sponge rubber or a soft synthetic resilient material such as urethane foam. The ball will usually be spherical but other geometric shapes may also be used. It has extending generally perpendicular to the surface thereof a multiplicity of soft, flexible elongated protrusions or "whiskers", for lack of a more precise term. These whiskers will generally have a length in the range of about 0.5–2.5 times the diameter of the ball, preferably roughly equal to the ball diameter. The length may vary depending on the particular characteristics desired for the intended end use. The whiskers may be integrally molded with the ball but they are preferably separately attached. The quantity, size, placement, and flexibility of the whiskers may again vary depending on the intended end use.

The design provides a ball with sufficient mass that allows it to be thrown or otherwise propelled at fast speeds or long distances while at the same time travelling straight. The whiskers have a function that gives the ball a number of advantages. When the ball is rolling they cause a rapid loss of momentum so that roll distance is controlled. They serve other useful purposes. The travel of the ball is more readily tracked visually because the whiskers make it appear larger. It is an ideal juggling ball since it is more visible both to the juggler and audience. This same feature is valuable in developing catching and throwing motor skills in a young child or disabled person. Because the ball is soft and comes rapidly to a stop when rolled it enables many outdoor games, such as croquet, to be safely and conveniently played indoors.

When propelled with a spinning or rolling motion, centrifugal force will cause the whiskers to be fully extended. In this configuration they cause the maximum air resistance, or friction if rolling on a firm surface, causing the ball to rapidly decelerate.

Flexibility of the whiskers is important to the function of the invention. They should not be so soft that they drape limply from the ball, as would normally be the case with cord or string. In this case they would generally fail to perform the necessary functions outlined above. Neither should they be so stiff that they would act as spines or hard bristles. In this case they could make catching the ball difficult or painful and they could also contribute a physical hazard. Further they would fail to serve their intended function of slowing down a rolling ball as effectively.

The nature of the whiskers can generally be defined by their drape properties as determined by the following test. A piece of the whisker material 2½ inches (63.5 mm) long is held horizontally at one end. The opposite or loose end should normally drape within a range of about ¾ inch (19 mm) to 2 inches (51 mm), preferably about 1¼ to 1¾ inches (32–44 mm). Measurement is made horizontally from a vertical line projected normal to and below the restrained end. Stated otherwise, the free end will have a droop in the range of about ¾ inch to about 2¼ inches (19–57 mm) below the projection of a horizontal line at the point of suspension.

A number of materials are suitable for use as whiskers. In general these will be selected from extruded polymeric fibers, which may be either hollow or solid. Normally they will have an outside diameter of at least about 1 mm. An excellent material having good durability is small latex rubber surgical tubing having an outside diameter of about 2 mm.

The balls and whiskers can be made in any color or combination of colors.

Reference should now be made to the figures where the construction of the invention will be readily apparent. Like numbers are used throughout for like elements. In FIG. 1 the novelty ball 2 is comprised of a molded foam rubber ball 4 and a multiplicity of generally equally spaced flexible whiskers 6. These extend radially from the center of the ball so that they are perpendicular to a line normal to the surface at the point of entry of the whisker. If the ball can be regarded in terms of global latitude, there is a ring of spaced apart whiskers around the equator, a smaller number arranged at 45° north and south latitude, and one at each pole. In the case of a ball about 2½ inches in diameter, 8 whiskers located at the equator, 4 whiskers at each 45° location, and one at each pole has proved eminently satisfactory. The whiskers in this case are 2½ inches (63.5 mm) long with a drape of about 1¼ inch (31.8 mm) and are made of latex rubber surgical tubing about 2.3 mm in diameter.

As was noted earlier, the whiskers can be integrally molded with the ball. However, this construction tends to lack the desired durability. Separate whiskers may be inserted and adhesively bonded into the ball. A preferred method is to use an inserted retainer or anchor for each individual whisker. Two variations of suitable retainers are shown in FIGS. 2 and 3. One adapted for a tubing-type whisker is shown at 10 in FIG. 2. This has a shouldered point portion for easy insertion and firm retention in the ball, and a tang portion with one or more expanded circumferential bands to firmly hold the tubing. The retainer 12 of FIG. 3 is used to hold a solid fiber. It has a shouldered point similar to the other one and a tang with two holes to tightly hold the whisker. Either variation may be readily inserted into the ball by a simple tool 14, as seen in FIG. 4.

It will be readily apparent to those skilled in the art that many variations could be made in the present invention that have not been described. These should be considered to fall within the scope of the invention as it is defined by the following claims.

I claim:

1. A novelty ball useful for the development of motor skills and for other purposes which comprises:

a long, generally spherical ball formed of a soft, compressible, resilient material; and a multiplicity of flexible whisker means having one end anchored within and protruding from the ball generally along radii thereof, said whiskers having at least some drape when the ball is at rest but not so much drape so that they hang limply from the ball.

2. The novelty ball of claim 1 in which the length of the whisker means falls within the range of about 0.5–2.5 times the diameter of the ball.

3. The novelty ball of claim 1 in which the whisker means have a drape in the range of about ¾–2 inches.

4. The novelty ball of claim 1 in which the whisker means are integrally molded onto the ball.

5. The novelty ball of claim 1 in which the whisker means are retained within the ball by inserted anchoring means.

6. The novelty ball of claim 5 in which the anchoring means has a shouldered point portion for easy entry into and firm retention within the ball and a tang portion for retention of the whisker means.

7. The novelty ball of claim 1 in which the whisker means are formed from extruded polymeric materials having a crossectional diameter of at least about 1 mm.

8. The novelty ball of claim 7 in which the whisker means are formed from surgical-type latex rubber tubing.

9. The novelty ball of claim 1 in which the whisker means are generally equidistantly spaced on the surface of the ball.

10. The novelty ball of claim 7 in which the whisker means are generally equidistantly spaced on the surface of the ball.

* * * * *

UNITED STATES PATENT AND TRADEMARK OFFICE

CERTIFICATE OF CORRECTION

PATENT NO. : 4,927,141

DATED : May 22, 1990

INVENTOR(S) : Arlen C. Paranto

It is certified that error appears in the above-identified patent and that said Letters Patent is hereby corrected as shown below:

In column 2, at line 68, "contribute" should read --constitute--.

In column 4, at line 16, (claim 1) "long" should read --solid--.

Signed and Sealed this

Third Day of March, 1992

*Attest:*

HARRY F. MANBECK, JR.

*Attesting Officer*

*Commissioner of Patents and Trademarks*